US007124679B2

(12) United States Patent
Daniel et al.

(10) Patent No.: US 7,124,679 B2
(45) Date of Patent: Oct. 24, 2006

(54) LOWER GUIDE TRACK FOR DOWN PACKING PRESS APPARATUS AND METHOD

(75) Inventors: Barton Wade Daniel, Kennesaw, GA (US); Scott Shepard, Lubbock, TX (US); Glenn Ellison, Lubbock, TX (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 10/925,678

(22) Filed: Aug. 25, 2004

(65) Prior Publication Data

US 2006/0042476 A1 Mar. 2, 2006

(51) Int. Cl.
*B65B 13/04* (2006.01)
*B65B 13/02* (2006.01)

(52) U.S. Cl. ..... 100/26; 100/3

(58) Field of Classification Search ..... 100/2, 100/3, 25, 26; 53/399, 589
See application file for complete search history.

(56) References Cited

U.S. PATENT DOCUMENTS

| | | | | |
|---|---|---|---|---|
| 3,470,813 | A | 10/1969 | Nomm et al. | 100/4 |
| 3,720,158 | A | 3/1973 | Sauer et al. | |
| 4,043,261 | A | 8/1977 | Mae | 100/26 |
| 4,559,977 | A | 12/1985 | Dilley | 140/93.6 |
| 4,561,349 | A | 12/1985 | Grenon | 100/26 |
| 4,611,534 | A | 9/1986 | Kudlicka et al. | 100/26 |
| 4,625,635 | A | 12/1986 | Lewis | 100/26 |
| 5,755,084 | A | 5/1998 | Dekker | 53/589 |
| 5,778,772 | A | 7/1998 | Schwede | 100/26 |
| 5,890,423 | A | 4/1999 | Lin | 100/26 |
| 6,415,712 | B1 | 7/2002 | Helland et al. | 100/26 |
| 6,516,592 | B1 | 2/2003 | Kimmerle | 53/589 |
| 6,553,900 | B1 | 4/2003 | Daniel et al. | 100/26 |
| 6,571,691 | B1 | 6/2003 | Jones | 100/26 |
| 6,575,086 | B1 | 6/2003 | Pearson et al. | 100/26 |
| 6,637,324 | B1 | 10/2003 | Stamps | 100/26 |
| 6,701,831 | B1 * | 3/2004 | Jones et al. | 100/3 |
| 6,705,214 | B1 | 3/2004 | Stamps | |

OTHER PUBLICATIONS

Communication Relating to the Results of the Partial International Search dated Jan. 12, 2006.

* cited by examiner

*Primary Examiner*—Derris H. Banks
*Assistant Examiner*—Jimmy T. Nguyen
(74) *Attorney, Agent, or Firm*—Husch & Eppenberger; Grant D. Kang

(57) ABSTRACT

The lower guide track sections for a bale binder engaged with a down press include a platen portion substantially as long as a platen slot and dimensioned for deployment within the platen slot. Track extensions extend outward from the platen. The first extension has a strap receiving end face that to cooperates with a first strap guide track on a carriage such that the first strap guide track on the first carriage is dimensioned to index laterally beyond a press frame. A second extension having a strap exit end face cooperates with a second strap guide track on a second carriage such that the second strap guide track on the second carriage is dimensioned to index laterally beyond the press frame. First and second guide track sections are mounted on laterally displaceable carriages and each have an exit end face, the end faces operatively cooperate with the receiving end faces of the extensions. The first carriage guide track section exit end face and the second carriage guide track section receiving face each have a medial border dimensioned to define a clearance length.

29 Claims, 7 Drawing Sheets

LOWER GUIDE TRACK FOR DOWN PACKING PRESS APPARATUS AND METHOD

CROSS-REFERENCE TO RELATED APPLICATIONS

None.

STATEMENT REGARDING FEDERALLY SPONSORED RESEARCH OR DEVELOPMENT

Not Applicable.

APPENDIX

Not Applicable.

BACKGROUND OF THE INVENTION

1. Field of the Invention

The present invention is in the field of automated bale binding apparatuses engageable with bulk material compressors, in particular down presses.

2. Related Art

Baling of bulk material such as cotton is achieved by a compression apparatus, usually hydraulic, that compresses a volume of bulk material into a preconfigured bale shape and size. While still compressed, a bulk material bale binding apparatus engages the volume of compressed material at a baling station and binds it with wire strap. The strap can be metal or plastic.

The binding wire or strap is placed around a compressed volume of material in a baling station by feeding the wire or strap through a guide track that circumscribes the volume of material to be baled and guides the wire or strap into a loop around the bale. The loop is on a single plane, typically transverse to a long axis of the bale. Thereafter the wire or strap is released from the track, tightened around the material to be baled and fastened or knotted. These procedures are described in detail in prior art such as U.S. Pat. No. 6,637,324 to Stamps and U.S. Pat. No. 6,553,900 to Daniel, incorporated by reference herein.

It is in the nature of the compression apparatus that the circumscribing guide track must be disengageable at least in part, so that the compression machinery can eject a finished bale and compress a new bale. Prior art devices have achieved the disengagement of a portion of guide track either by swinging it upwards and away from the baling station, or sliding it outward from the baling station. These prior art solutions are typified by a fixed guide track portion and a moveable guide track portion. Both of they portions always remained within the plane of the bale loop, whether disengaged or not.

One form of bale compression apparatus is called a down press. Down presses are completely above a floor level and generally comprised of a first and second compression box for receiving a volume of bulk material to be baled. A first box is typically filled with loose material while a second box is simultaneously compressed and baled. Filling a box with loose material happens at a first position engaged with a tramper, which fills the box. Bale binding occurs at a second position having a vertically oriented hydraulic press for compressing the volume of bulk material. Binding occurs at the compression station. The boxes are transposed from the filler station to the compression and binding station by rotation around a central column. The boxes, press and central column are supported by a frame comprised of two end columns and a support lintel. Any automated bale binding apparatus used to bind the compressed volumes of bulk material must disengage to a position outside the circumference of the rotation of the two boxes around the center column. Disengagement of binding equipment in a direction perpendicular to a plane defined by the support frame would require moving the apparatus an impractical distance. Accordingly, prior art disengagement apparatuses that disengage guide track portions within the same plane as the bale loop are impractical for use with down presses, because the bale loop plane is perpendicular to the support frame.

Accordingly, there is a need in the art for automated bale binding equipment for use with down presses that disengages in a direction parallel with the frame of the down press and in a direction nonparallel to the bale loop plane. Concomitantly, there is a need for guide track components that are disengageable in a manner allowing such a lateral disengagement of the binding apparatus from the baling station. Additionally, there is a continuing need in the art for durability, compact size, and economy.

Further problems to address in automating binding of bales compressed by down presses include the following. Down presses commonly have a stand to be placed on the floor. On top of the stand is a bed which holds a lower platen and support structure for that platen. The support structure includes the slots into which lower guide track sections are inserted. The beds have preexisting dimensions of width and depth. These dimensions necessarily correspond to the dimensions of the compression boxes with which they interact. Accordingly, any lower guide track sections to be used for bale binders designed to be interoperative with down presses must be fit within the preexisting dimensions of the beds.

Another dimension to be accommodated is the space, sometimes known as a "stand off" space, between a wire knotter and the nearest edge of bale. If the stand off is too large, that is if the knotter is too far away from the bale, the resulting wire loops will be too large, and the bale will expand beyond the dimensions required to comply with the standards of the International Cotton Council for bale size. This stand off distance is on the order of seven inches.

Another design problem required to be met for automated baling with down packers is a minimum turning radius of guide track corner portions. This minimum radius is also in the order of seven inches. The most economical grade of wire to use that complies with the International Cotton Council standards for post binding strength and durability is 10 gauge wire. It is a property of 10 gauge wire that if a guide track guidance channel turns too sharply, that is, has a total turning radius of less than seven inches, the wire will frequently "jump" its track and jam. Therefore a shorter turning radius is impractical. There is a need in the art for an automatic bale binder for a down press that accommodates preexisting bed dimensions while still maintaining an adequate turning radius for 10 gauge wire.

SUMMARY OF THE INVENTION

It is in view of the above problems that the present invention was developed. The invention is a lower guide track section for a bale binder engaged with a down press including a platen portion substantially as long as a platen slot and dimensioned for deployment within the platen slot; a first extension, the first extension extending outward from a first extent of the platen; a second extension, the second extension extending outwards from a second extent of the platen in a direction opposite the first extension; the first extension having a strap receiving end face configured to cooperate with a first strap guide track on a carriage such that the first strap guide track on the first carriage is dimensioned to index laterally beyond a press frame; the second extension having a strap exit end face configured to cooperate with a second strap guide track on a second carriage such that the second strap guide track on the second carriage is dimensioned to index laterally beyond the press frame each of the receiving end face and said exit end face having a medial border and a peripheral border; a first guide track section being adapted for mounting on a laterally displaceable carriage and having an exit end face, the exit end face being adapted to operatively cooperate with the receiving end face of the first extension; a second carriage guide track section being adapted for mounting on a second laterally displaceable carriage and having a receiving end face, the receiving end face being adapted to operatively cooperate with the exit end face of the second extension; the first carriage guide track section exit end face and the second carriage guide track section receiving face each having a medial border and a peripheral border; the medial borders of the first and second carriage guide track section end faces being dimensioned to define a clearance length.

The invention further comprises guide track dimensions designed to accommodate the preexisting dimensions of down packer beds, while maintaining an optimal turning radius for guiding 10 gauge wire without jamming. The resolution of these industry problems is two-fold. First, a turning radius of a guide track channel is begun while the channel remains under the platen. Secondly, a first turning radius of 30 to 45 degrees is combined with a second turning radius 30 to 45 degrees. Within the guide track extensions these separate turning radiuses are separated by an intermediate portion having a much shallower arc or which may be substantially flat. It is another property of 10 guage binding wire that, when driven at high speeds, has a lower tendency to jam if turned incrementally, rather than continuously.

Further features and advantages of the present invention, as well as the structure and operation of various embodiments of the present invention, are described in detail below with reference to the accompanying drawings.

BRIEF DESCRIPTION OF THE DRAWINGS

The accompanying drawings, which are incorporated in and form a part of the specification, illustrate the embodiments of the present invention and together with the description, serve to explain the principles of the invention. In the drawings.

DETAILED DESCRIPTION

Figure 1:
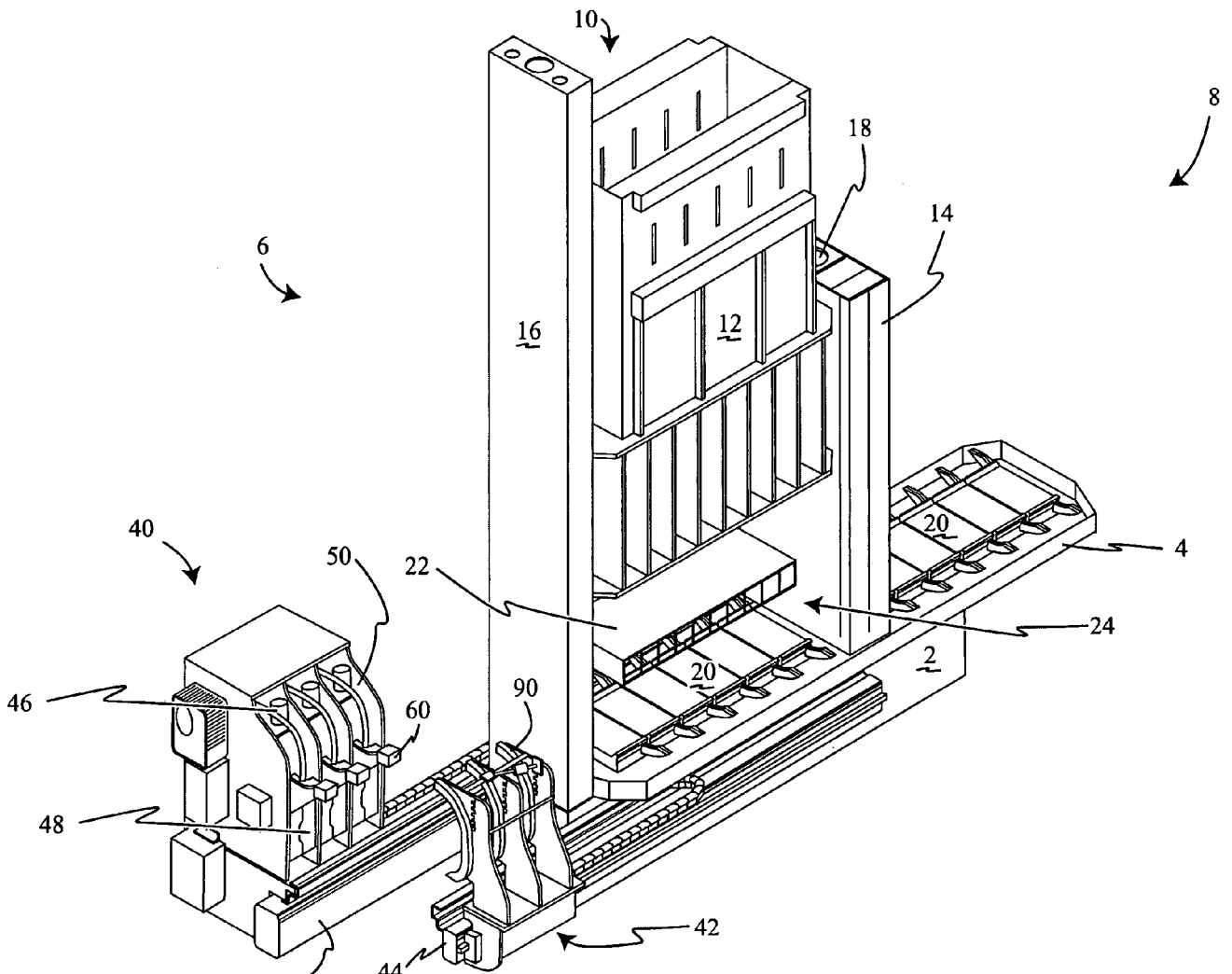
FIG. 1 is a perspective view of a down packer and a laterally displaceable binder apparatus.

As shown in FIG. 1, the down press 10 is comprised generally of a compression and baling side 6 and a compression box loading side 8. A second compression box is omitted for clarity on the loading side 8. While a first bale is being compressed and bound in baling station 24, oriented on the near side of the perspective image in FIG. 1, a second compression box is being loaded with cotton at the loading side 8. Compression boxes 12 are moved from the loading size 8 to the baling side 6 by rotation around a vertical axis comprised of central piston 18 within central column 14. That is, the compression box 12 and central column 14 rotate and the compression box 12 moves to the baling side 6 with a load of loose cotton, there to be compressed from above by hydraulics (not show). A bed 4 also rotates.

The components of the down press that remain stationary are base 2 and end column 16. A stationary opposite end column and lintel are omitted for clarity.

On the baling side 6 of the down press a baling station 24 is formed. The baling station is comprised of one of the lower platens 20 or 20'. The lower platen 20 receives, restrains and resists against compression a volume of bulk material being pressed down onto it from above. The cotton is pressed down and the top side of the baling station is formed by upper platen 22. Upper platen 22 is connected to the vertically oriented downwards moving hydraulics (not shown) that move through the compression box 12.

After a volume of bulk material has been compressed and bound with wire or strap, it is ejected from baling station 24. Simultaneously with the bale binding operation, the other compression box has been loaded at loading side 8. Thereafter, the down press rotates again and through its rotation transposes the position of the now empty compression box 12 and the other compression box (not shown), now loaded with uncompressed cotton. Clearly, in order to operate, there must be a clear path for 360 degrees around center axis 18 with a radius equal to the width of a compression box 12 and the bed 4. Accordingly, any binding equipment must be withdrawn beyond that radius.

In order to do this, the binding apparatus of the present invention comprised is generally of a first carriage 40 and a second carriage 42. Each carriage is comprised of an assembly of mounting brackets 50, generally vertically oriented. Carriage 40 rides laterally on a rail 41. Likewise, carriage 42 rides on rail 44. The rails are oriented to be parallel with the bed 4 and the long side of the compression box 12. The top of the rail is at or below the level of the bottom of the bed 4, so that the bed will clear the rails when rotated. The first carriage 40 also carries with it multiple wire or strap drivers 46 and multiple wire knotters or strap fasteners 48. In the depicted embodiment, carriage 40 carries three wire drivers 46 and three knotters 48. There are six baling wires to be installed on a standard bale of cotton. Accordingly, in addition to translating along rails 41 and 44 to be withdrawn from the down press 10, the bale binding apparatus of the depicted embodiment also translates between a first three binding wire positions and a second three binding wire positions.

Guide rails work in a known fashion, such as described in U.S. Pat. No. 6,637,324 to Stamps and U.S. Pat. No. 6,553,900 to Daniel, incorporated by reference herein. Essentially, two longitudinal portions of any guide track portion are biased together by springs. Between the longitudinal sections 100A, 100B is a longitudinal channel for receipt and guidance of a progressing bale wire FIG. 6. The various guide track portions are oriented around a baling station, and consequently a bale, in order to complete a loop of baling wire around the volume of bulk material to be baled. Thereafter a tensioning mechanism retracts the baling wire or strap out of the track and around the bulk material. The tension placed on the bale wire or strap in a radially inward direction is sufficient to overcome the bias approximating the lateral guide sections together, thereby releasing the wire or strap from the guide track, and drawing it against a bale. The wire is then fastened.

An overall guide track of the present invention is comprised of guide track portions that reside in the lower platens 20 and 20', that reside in the upper platen 22 and the guide track portions that form components of the carriages 40 and 42.

Figure 2:
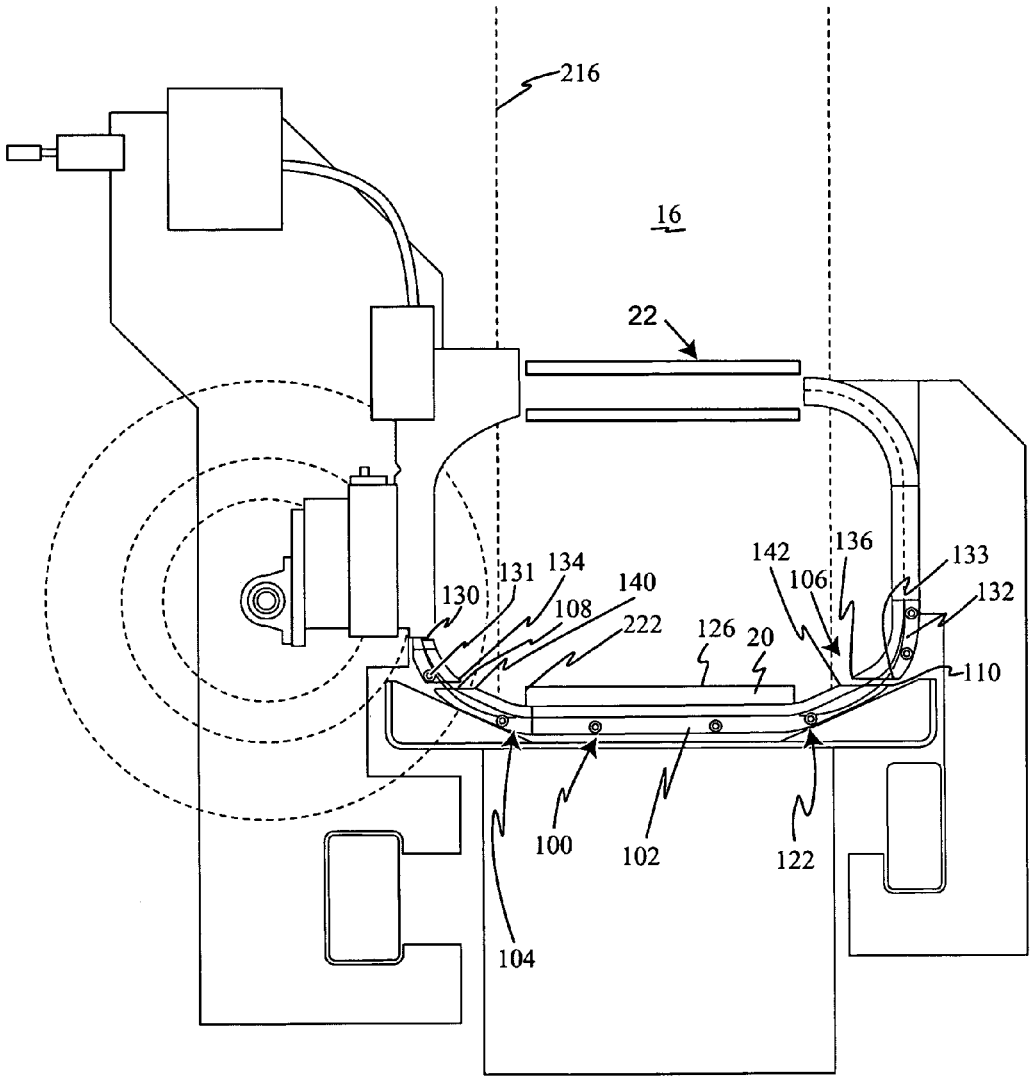
FIG. 2 is a schematic side view of the guide track of the present invention.

FIG. 2 shows the bale binding apparatus of the present invention in its inward position, with its guide tracks disengaged. In FIG. 2, end column 16 and center column 14 are depicted along with bed 4 and stand 2 of the down packer. The compression box 12 has been omitted for clarity. Upper platen 22 appears, but the mechanisms that support it in the depicted compressed and ready to bale position i.e., the hydraulic press, has been omitted for clarity.

Figure 3:
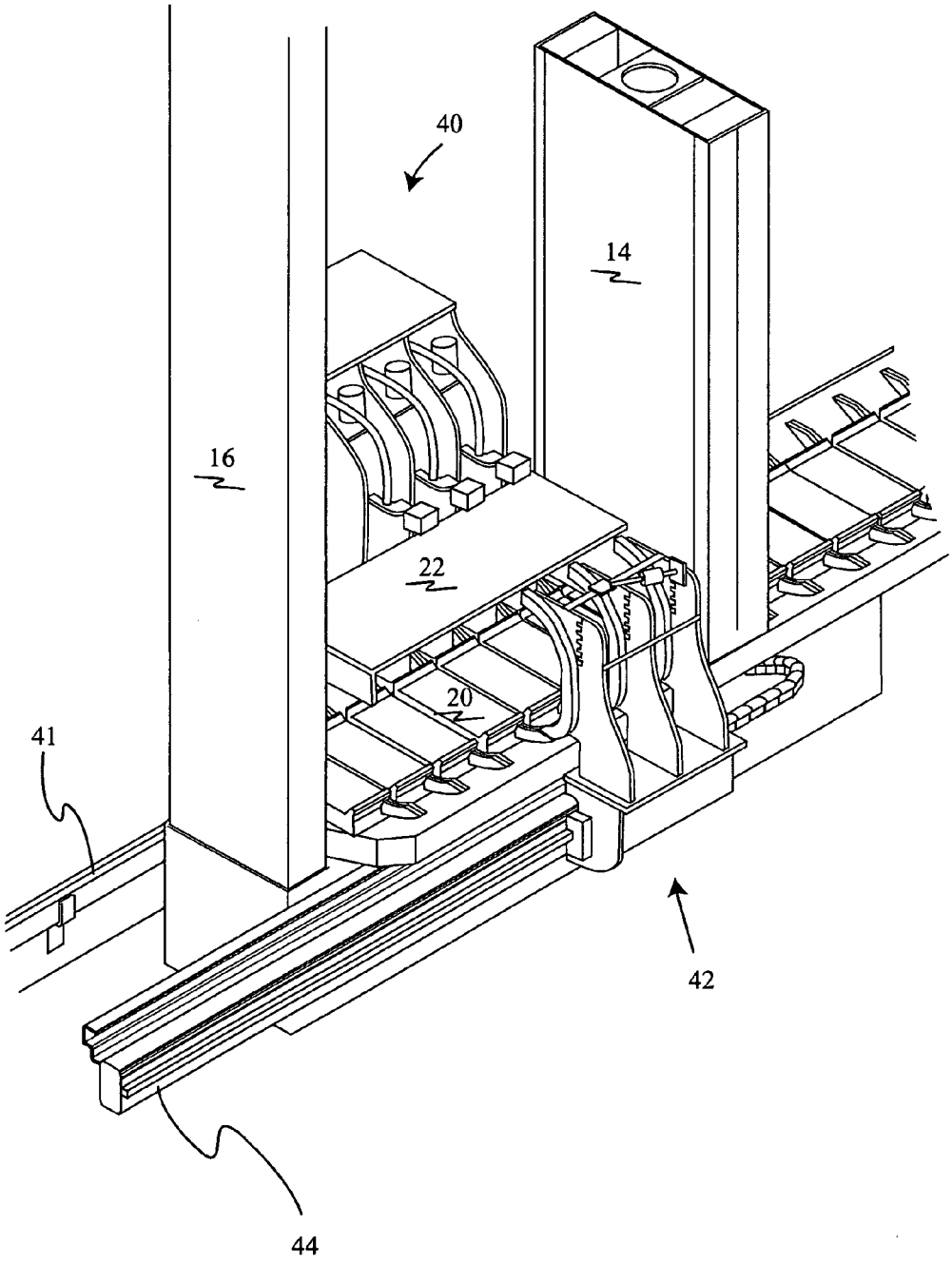
FIG. 3 is a perspective close up view of the bale binding loops of the present invention.
Figure 4:
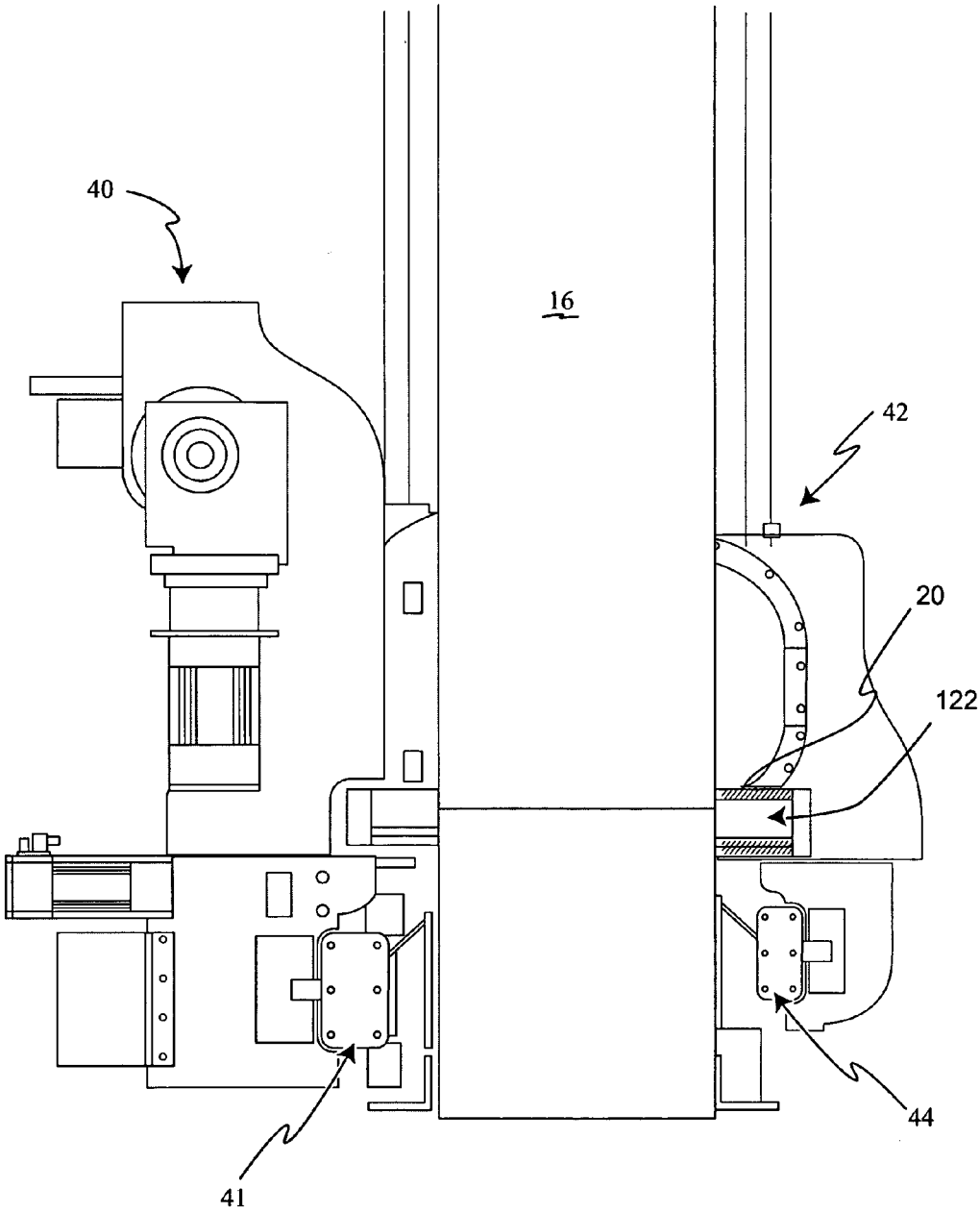
FIG. 4 is a side view of the bale binding loops.
Figure 5:
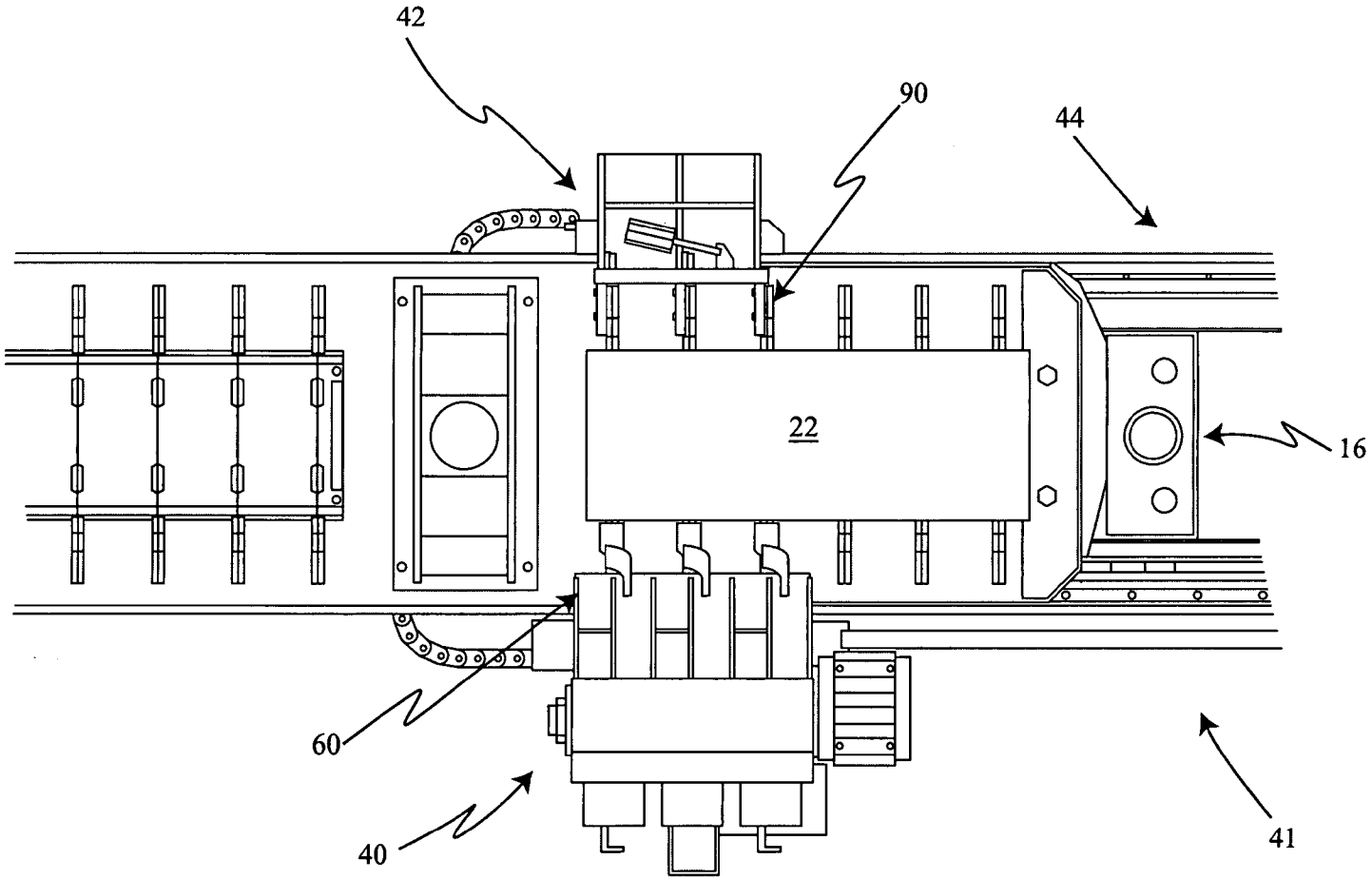
FIG. 5 is a top view of the bale binding loops.

It is apparent from FIGS. 2 and 3, and particularly top views 4 and 5 that the width of the upper platen 22 is less than the width of the end column 16. In order for guide tracks to work properly, the gap between one guide track portion and the next must be relatively narrow, on the order of about an inch. End column 16 is substantially more than an inch wider than upper platen 22. Accordingly, in order for the carriages 40 and 42 to translate laterally out of and back into binding position, the guide track portions mounted on the carriages 40 and 42 must have a dimension sufficiently wide for those components to clear the end column 16. The present invention is directed towards overcoming this problem in an economical, durable, fast and precise way.

Both carriages 40 and 42 have upper guide track portions 60 and 90. These guide track portions are mounted such that they have an extended, engaged position which extends closer to one another, and narrows the gap between. This narrower space corresponds to the width of the upper platen 22, thereby bringing the upper guide track portions 60 and 90 into operative engagement and close, operative communication therewith. Upper guide track portions 60 and 90 also have a removed position characterized by the fact that the removed position widens the gap between upper guide track portions 60 and 90 to a width sufficient to clear the end column 16 when the carriages 40 and 42 translate out of baling position, to allow the down packer to rotate.

The laterally displaceable guide track portions and their mounting and actuation of the present invention may be deployed in any number of bale loop assemblies. Although in the depicted embodiment, three are shown, any where from one to eight, of guide track assemblies, corresponding to the number of loops on a standard (6) or a universal (8) bale, or less, is within the scope of the present invention.

The lower guide track section 100 is dimensioned for deployment within a platen slot 122 of the lower platen 20. The lower guide track 100 is comprised of a platen section 102, a first extension 104 and a second extension 106. The first extension has a strap receiving end face 108. The second extension 106 has a strap exit end face 110. In the depicted embodiment, an uppermost extent of the receiving end 108 and the exit end 110 of the lower guide track 100 is substantially coextensive with a lower platen bed 4 in its upper extent. That is, the uppermost extent of the lower guide track 100 is substantially at the same vertical level as the uppermost portion of the lower platen bed 4. In the depicted embodiment, this is slightly higher than the top face 126 of the lower platen 20. An upper extent of the first and second extensions that is substantially equal to the height of the upper surface 126 of the lower platen 20 is also within the scope of the present invention.

In the depicted embodiment, the receiving end face 108 and the exit end face 110 are substantially horizontal. Thus, the combination of lower platen 20, lower platen bed 4 and the lower guide track 100 present a single horizontal plane over which an exit end of a first carriage guide track section 130 and a receiving end of a second carriage guide track section 132 may translate laterally without interfering with either the platen bed 4 or any other components of the down press. Each of said first carriage guide track section 130 and said second carriage guide track section 132 has an end face, 131 and 133 respectively. The first carriage guide track section end face 131 and the receiving carriage guide track section end face 133 are also substantially horizontal. Thus, when the first and second carriages are indexed into an engaged position, the exit end face 131 of the first carriage guide track section closely cooperates with the receiving end face 108 of the lower guide track 100 and, similarly, the exit end face 110 of the lower guide track closely cooperates with the receiving end face 133 of the second carriage guide track section 132.

The extensions 104 and 106 allow the vertical guide track sections 130 and 132 to be dimensioned to avoid an end column of the press when their carriages are withdrawn. That is, the extensions 104 and 106 are long enough for the vertical tracks 130 and 132 to be short enough to be laterally withdrawn without hitting the down press end column.

Figure 7:
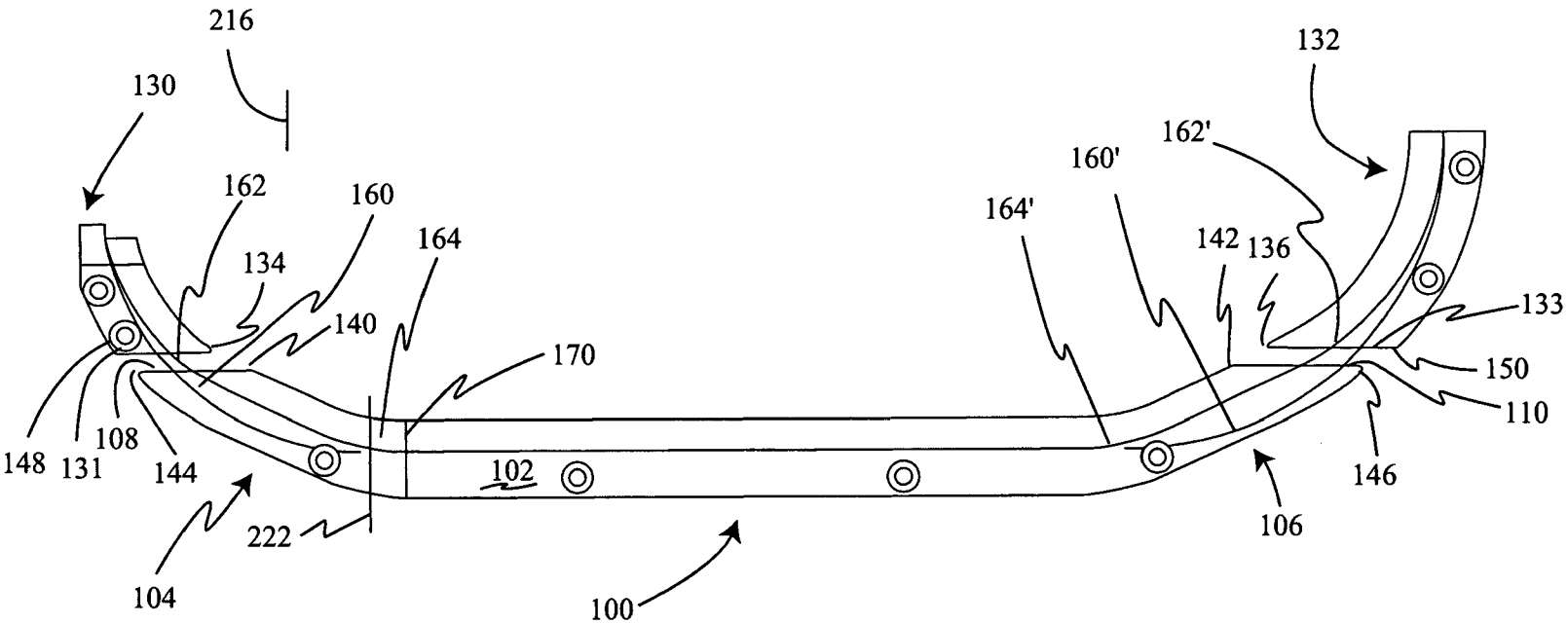
FIG. 7 is a side view of the lower guide track of the present invention.

The first extension receiving face 108 and the second extension exit face 110 of the lower guide track 102 each have a medial border 140, 142 respectively and a peripheral border 144, 146 respectively (best seen in FIG. 7). In the depicted embodiment, the medial borders 140, 142 are dimensioned such that they are outside a clearance length.

The exit face 131 of the first carriage guide track section 130 and the receiving face 133 of the second carriage guide track section 132 each also comprise a medial border 134, 136 respectively, and a peripheral border 148, 150 respectively (best seen in FIG. 7). The medial border 134 of the first carriage guide track section 130 is outside a clearance dimension, as is the medial border 136 of the receiving face 133 of the second carriage guide track section 132. The clearance length is dimensioned such that it is at least as long as the down press end column is wide. That is, the clearance length is dimensioned such that upon a lateral withdrawal of the carriages past the end column, any component outside the clearance length will not touch the end column of the down press.

Figure 6:
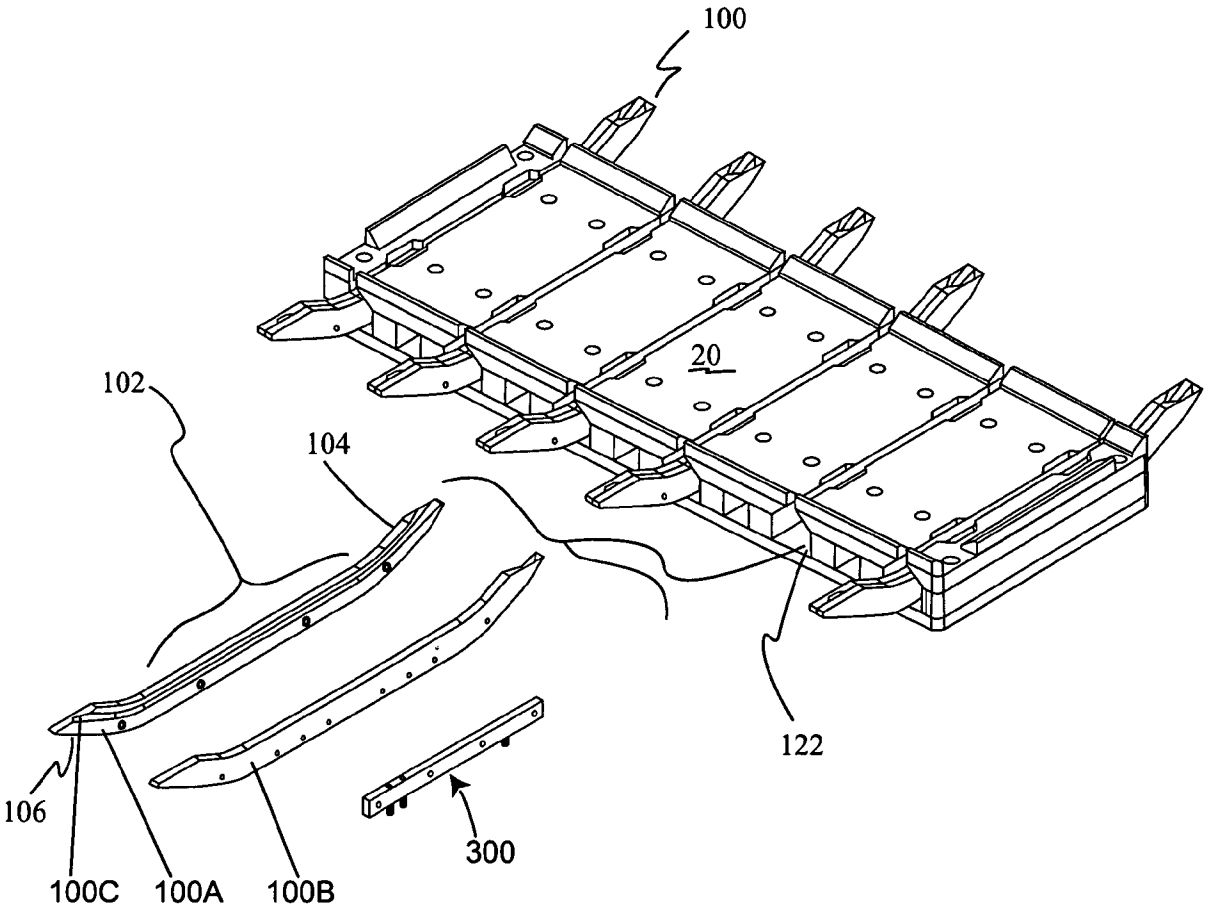
FIG. 6 is a perspective view of the lower guide tracks sections and lower platen.

The lower guide track 100 is also dimensioned such that it may be manually inserted and withdrawn in sliding engagement with the lower platen slot 122 when the carriages are laterally withdrawn, for maintenance or repair. As best seen in FIG. 6, a mounting bar 300 may be used to mount the lower guide track 100 in the lower platen slot 122. For example. mounting bar 300 may be fixed to the platen section 102 of the lower guide track 100.

FIG. 7 depicts a side view of the lower guide track section 100, first carriage guide track section 130 and return guide track carriage section 132. Also depicted on FIG. 7 is an indication of one outer edge 222 of the lower platen 20, and a demarcation 216 of the outer edge of the end column 16. The later outer edge dimension 216 of the end column defines a minimum clearance length.

On the first extension 104, the first extension receiving face 108 is depicted. The first extension receiving face lies between a first extension receiving face medial border 140 and a first extension receiving face peripheral border 144. The second extension 106 includes exit face 110, which lies between the exit face medial border 142 and the exit face peripheral border 146. The first carriage guide track section exit face 131 lies between its medial border 134 and its peripheral border 148. The second carriage vertical guide track section receiving face 133 lies between its medial border 136 and peripheral border 150.

Also depicted in FIG. 7 are the dimensions of the turning radius within each guide track portion. These radii include an effective radius 160 and 160'. The effective radius is comprised of an upper radius 162 and 162' and a lower radius 164 and 164'. Between these is an area of relative flattening.

FIG. 7 designates a position at which a turning radius of the guide tracks begins, at 170. This turning radius begins inside the outer edge 222 of the platen 20.

FIG. 7 depicts at least three novel elements that are combined in order to address the problem of retaining the lower guide track within the preconfigured bed dimensions, maintaining a knotter stand off dimension that is adequately close to the side of the bale, and turning the bale wire through a sufficiently gradual arc to prevent jamming. These elements include beginning the turning radius at a point inside outer edge 222. Thus the baiing wire has begun its upwards turn even while it continues to progress horizontally underneath the baie. Next, the channel turn is executed incrementally, with a lower radius 164 and an upper radius 162, separated by an area of relative flattening. The intermediate area may be literally flat for some distance, or may simply be an arc that is broader, that is having a greater turning radius, than the effective radius 160. Thus, the channel 100C within the guide track is dimensioned to make a first incremental turn, allow the wire to travel a distance with little or no turning, and then make a second incremental turn. In the depicted embodiment, each of the upper radius 162, 162' and lower radius 164, 164' is in the range of 35 to 40 degrees. These angles incorporate critical values found to dramatically reduce the incidence of jamming.

A final element in accommodating minimum turning radius of the wire in combination with the preconfigured bed dimensions and the necessaiy stand off dimension is to finish the turn of the guide wire with the channel inside the first carriage guide track section 130. Whereas prior art taught that a first carriage guide track section would incorporate a complete 90 degree turn and have a substantially vertical exit face 108, in the present invention the exit face 110 relative to the channel 100C passing through it is not perpendicular.

In operation, the carriages 40 and 42 of the bale binding apparatus are withdrawn, which is to say laterally displaced along rails 41 and 44. A finished bale is removed or ejected from the baling station 20 of baling side 6 of the down packer 10. While this bale has been bound, the other compression box (not shown) has been loaded with loose bulk material at loading portion 8 of down packer 10. With the carriages 40 and 42 laterally displaced a sufficient distance, the down packer central column and compression boxes 12 rotate around the vertical axis of center pivot 18. The upper platen 22 has been withdrawn upwards to provide clearance for rotation of compression box 12. When the new compression box 12, now full of loose material, has arrived at the binding portion 6 of the down packer 10, the carriages 40 and 42 translate laterally along rails 41 and 44 until they arrive at a first binding position engaged with the baling station 20.

In an embodiment having six bale loop guide tracks, knotters and drivers, there will only be one bale binding position. In the depicted embodiment, having three bale loop guide tracks, there will be two binding positions for the carriages 40 and 42. During withdrawal, and translation of the carriages 40 and 42, all of the guide track portion 60 and receiving guide track portions 90 are in their retracted, disengaged position.

Either sequentially with or simultaneously with the compression of the bulk material through compression box 12 by vertically oriented and downward progressing of the hydraulics (not shown), the carriages 40 and 42 are in baling position when the top platen 22 has extended completely downwards. At this point, the bulk material has been compressed and is maintained in its compression between lower platen 20 and upper platen 22. At this point, all moveable guide track portions 60 and all moveable receiving guide track portions 90 are swung around vertical pivots into their extended engaged positions. These are indexed to correspond to the matching lower guide track sections 130 and upper guide track sections 132 pre-positioned in the slots provided for them in the lower platens 20 and upper platens 22. At this point, there are three complete guide track loops, each in a separate and parallel plane. This plane is non-parallel with, and in the depicted embodiment, perpendicular to, the lateral axis of the rails on which the carriages 40 and 42 travel. The lateral direction of the rails corresponds to the long axis of the bale. Wire or strap (wire in the depicted embodiment) is then driven in a complete circuit around the bale through all guide track portions. When a leading end of the bale wire arrives at the knotter attached to the carriage 40, a gripper, as is known, retains the leading edge, drive apparatuses are reversed in order to pull the wire out of guide track, also in a known fashion, so that the wire is drawn into contact with the bulk material being baled. Thereafter a knotter knots the leading and trailing ends of the wire. Thereafter the carriages 40 and 42 translate laterally from a first baling position engaging a first three set of guide tracks to a second baling position engaging the second three sets of guide tracks. The baling process repeats.

At this point, all six bale wires are in place and knotted and compressing pressure may be released. In the case of the down packer as depicted, pressure is released by raising the upper platen 22 with the vertical hydraulics. Either sequentially or simultaneously with a release of pressure, the carriages 40 and 42 may not be laterally translated out of engagement with the baling station 24 and the rest of the down packer 10.

In view of the foregoing, it will be seen that the several advantages of the invention are achieved and attained.

The embodiments were chosen and described in order to best explain the principles of the invention and its practical application to thereby enable others skilled in the art to best utilize the invention in various embodiments and with various modifications as are suited to the particular use contemplated.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A lower guide track section for a bale binder engaged with a down press, the down press having a lower platen with a platen slot and having a frame, said lower guide track section comprising:

two longitudinal sections defining a channel therebetween, the two longitudinal sections comprising:

a platen section substantially as long as the platen slot and dimensioned for deployment within said platen slot;

a first extension extended from the platen section, said first extension extending outward from a first extent of the platen; and a second extension extended from the platen section, said second extension extending outwards from a second extent of the platen in a direction opposite said first extension; and a mounting bar, said mounting bar being fixed to said platen section of said lower guide track section and said mounting bar being adapted to mount said lower guide track section within said platen slot.

2. The guide track section of claim 1 wherein said first extension has a strap receiving end face configured to cooperate with a first guide track section on a first carriage;

said second extension has a strap exit end face configured to cooperate with a second guide track section on a second carriage;

each of said receiving end face and said exit end face has a medial border and a peripheral border;

said first guide track section has an exit end face, said exit end face being adapted to operatively cooperate with said receiving end face of said first extension;

said second guide track section on said second carriage has a receiving end face, said receiving end face being adapted to operatively cooperate with said exit end face of said second extension;

said first guide track section exit end face and said second guide track section receiving face each has a medial border and a peripheral border;

said medial borders of said first and second guide track section end faces are dimensioned to define a clearance length, said clearance length being greater than a frame element to be cleared by said first carriage and said second carriage; and said end faces of said first and second extensions are below a level of a top of said lower platen.

3. The lower guide track section of claim 2 wherein said medial borders of said end faces of said first and second extensions define said clearance length.

4. The lower guide track section of claim 2 wherein said channel executes a 90 degree turn through said first extension and said first guide track section.

5. The lower guide track of claim 2 wherein said channel executes a 90 degree turn through said second extension and said second guide track section.

6. The lower guide track of claim 4 wherein said channel executes a 90 degree turn through said platen section, said first extension, and said first guide track section.

7. The lower guide track of claim 5 wherein said channel executes a 90 degree turn through said platen section, said first extension, said first guide track section.

8. The lower guide track of claim 1 wherein said channel defines a first turn and a second turn in one of said first or second extensions, said first turn and said second turn being separated by an intermediate length, said intermediate length having a shallower arc of travel than said first turn and said intermediate length having a shallower arc of travel than said second turn.

9. The lower guide track of claim 1 wherein said channel is vertical at an entry or exit of a first guide track section, and said vertical exit of said channel is positioned approximately seven inches from a nearest side of a bale.

10. The lower guide track of claim 2 wherein said exit faces and receiving faces are non-perpendicular to said channel.

11. A lower guide track for disposition in a bale binder engaged with a down press, the down press having a frame, a first carriage section, a second carriage section, and a lower platen with a platen slot, said lower guide track comprising:

two longitudinal sections defining a channel therebetween, the two longitudinal sections comprising:

a platen section, said platen section being dimensioned for disposition within the platen slot;

a first extension extended from said platen section and said first extension extending beyond an edge of the lower platen, said first extension being mounted separately from the first carriage section and disposed to be in operative cooperation with the first carriage section when the first carriage section is in a baling station; and a second extension extended from said platen section and said second extension extending beyond a second edge of the lower platen, said second extension disposed to be in operative communication with the second carriage section when the second carriage section is in said baling station; and a mounting bar, said mounting bar being fixed to said platen section of said lower guide track and said mounting bar being adapted to mount said lower guide track within said platen slot.

12. The lower guide track of claim 11 wherein said platen section has a width substantially equal to a width of the lower platen and wherein said channel turns within said platen section.

13. The lower guide track of claim 12 wherein said channel turns on both ends of said platen section.

14. The lower guide track of claim 11 wherein a 90 degree turn of said channel is completed through said first extension and said first carriage section.

15. The lower guide track of claim 11 wherein a 90 degree turn of said channel is completed through said second extension and said second carriage section.

16. The lower guide track of claim 11 wherein said 90 degree turn of said channel is completed through said platen section, said first extension, and said first carriage section.

17. The lower guide track of claim 11 wherein said 90 degree turn of said channel is completed through said platen section, said second extension, and said second carriage section.

18. The lower guide track of claim 11 wherein said channel becomes vertical within said first or second carriage sections, and wherein said vertical portion of said channel is approximately seven inches from a nearest edge of a bale.

19. The lower guide track of claim 11 wherein, substantially within either of said first extension or second extension, said channel defines a first turn having a first radius, a second turn having a second radius, said first and second turns being separated by an intermediate length, said intermediate length having a third radius, said third radius being greater than said first radius and said third radius being greater than said second radius.

20. The lower guide track of claim 19 wherein said intermediate length is substantially flat.

21. The lower guide track of claim 19 wherein said first radius and said second radius are substantially equal.

22. The lower guide track of claim 19 wherein at least one of said first radius and said second radius is at least approximately seven inches.

23. The lower guide track of claim 19 wherein one of said first or second turns is completed in one of said first or second carriage sections.

24. A method of guiding baling wire underneath a volume of bulk material to be baled by a down press comprising:

dimensioning a lower guide track for disposition in a lower platen of a down press bed, the lower guide track comprising a platen section substantially as long as the lower platen, a first extension extended from said platen section, said first extension extending outward from a first extent of the platen, and a second extension extending outward from a second extent of the platen in a direction opposite said first extension extended from said platen section, said second extension, and a mounting bar, said mounting bar being fixed to said platen section and said mounting bar being adapted to mount said lower guide track within a platen slot in the lower platen;

coordinating a first carriage guide track section and second carriage guide track section to operatively cooperate with said lower guide track when said first carriage section and said second carriage section are aligned with said lower guide track; and turning a channel within said lower guide track and at least one of said first or second guide track sections such that said channel becomes vertical substantially about seven inches from a nearest side of a bale.

25. The method of claim 24 wherein said turning step is at least partially executed in the platen section of said lower guide track.

26. The method of claim 24 wherein said turning step is executed through a first radius and a second radius, said first radius and said second radius being separated by an intermediate distance, said intermediate distance having a turn radius that is greater than said first turn radius and greater than said second turn radius.

27. The method of claim 26 wherein at least one of said first radius and said second radius is at least approximately seven inches.

28. The method of claim 24 wherein said turning step is executed within the first or second extension of said lower guide track and also within said first carriage section or said second carriage section.

29. The method of claim 24 wherein said turning step is executed within said platen section as well as the first extension of said lower guide track or the second extension of said lower guide track.

* * * * *